United States Patent [19]

Eddas et al.

[11] Patent Number: 5,020,127

[45] Date of Patent: May 28, 1991

[54] TANKLESS ELECTRIC WATER HEATER

[75] Inventors: Harry Eddas, Chattanooga, Tenn.; David O. Hanon, Ringgold, Ga.

[73] Assignee: Energy Saving Products of Tennesse, Inc., McKenzie, Tenn.

[21] Appl. No.: 465,638

[22] Filed: Jan. 22, 1990

Related U.S. Application Data

[63] Continuation of Ser. No. 112,098, Oct. 23, 1987, abandoned.

[51] Int. Cl.[5] ..... H05B 1/02; F24H 1/10

[52] U.S. Cl. ..... 392/488; 219/486

[58] Field of Search ..... 219/306–309, 219/298, 486, 320, 321; 392/485–490

[56] References Cited

U.S. PATENT DOCUMENTS

| | | | |
|---|---|---|---|
| 1,715,687 | 6/1929 | Vaughan . | |
| 2,866,884 | 12/1958 | Miner . | |
| 3,261,963 | 7/1966 | Weinstein | 219/321 X |
| 3,317,706 | 5/1967 | Fischer . | |
| 3,586,869 | 6/1971 | Kompelien | 219/486 X |
| 3,898,428 | 8/1975 | Dye | 219/306 X |
| 3,952,182 | 4/1976 | Flanders | 219/309 |
| 4,185,187 | 1/1980 | Rogers . | |
| 4,358,665 | 11/1982 | Owen | 219/306 |
| 4,567,350 | 1/1986 | Todd | 219/309 X |
| 4,645,907 | 2/1987 | Salton | 219/309 |

FOREIGN PATENT DOCUMENTS

| | | | |
|---|---|---|---|
| 127344 | 12/1984 | European Pat. Off. | 219/306 |
| 2400478 | 7/1975 | Fed. Rep. of Germany | 219/308 |
| 2286353 | 4/1976 | France | 219/306 |
| WO 87/03115 | 9/1982 | World Int. Prop. O. | 219/306 |

*Primary Examiner*—Anthony Bartis

*Attorney, Agent, or Firm*—Robert E. Knechtel

[57] ABSTRACT

An instantaneous fluid heater having a fluid heating chamber including therein a plurality of electrical heating elements. The supply of electrical power to the respective ones of the electrical heating elements is controlled by a solid state switch which is gated by a zero crossing trigger device to supply power to the heating elements. Each of the trigger devices includes means for comparing a control potential and ramp signal potential coupled to them to selectively gate the solid state switches to energize the heatiing elements in response to the comparison of the potentials. In this fashion, all of the heating elements are not turned on at the same time, and undesirable light flickering and unacceptable disturbances in the line voltage is eliminated.

6 Claims, 4 Drawing Sheets

TANKLESS ELECTRIC WATER HEATER

This is a continuation of co-pending application Ser. No. 112,098, filed Oct. 23, 1987 now abandoned.

BACKGROUND OF THE INVENTION

I. Field of the Invention

The present invention relates generally to the field of heating devices for heating water and more particularly to the provision of a heating device which is electrically controlled and heats water instantaneously on a demand basis immediately prior to the time the water is to be used.

II. Description of the Prior Art

In conventional devices for heating water there is normally provided a large storage tank of some 40–60 gallons in which water is stored after it has been heated, normally by electric or natural gas means. The storage tanks are usually sized to store all of the hot water that a consumer would normally demand in any given period of time. Because of the stand-by storage of the standard water tank, even the best insulated tank can lose as much as 20% or more of the heat necessary to keep a constant water temperature. Assuming that the water is to be used on a rather intermittent basis, the cost of keeping the water at a continuous temperature is extremely high with regard to a specific amount of water that is to be utilized.

Therefore, a conventional water heating system is inefficient when utilized for intermittent use. Logically speaking, intermittent use might even be considered in the normal household environment since frequently, water is used most frequently on a demand-basis during the morning and evening peak hours.

In the prior art, there have been instantaneous-type water heaters developed to heat the water immediately prior to its use. Typically, these "in-line heaters" supply water at a rather limited flow rate and that water is heated by methods which have been notoriously inefficient, thereby limiting the applicability of the instantaneous-type water heaters.

SUMMARY OF THE INVENTION

It is therefore an object of the present invention to provide a space-saving instantaneous-type water heater which supplies an unlimited supply of hot water at a high flow rate in a sufficient volume to be commercially accepted.

Yet another object of the invention is to provide an instantaneous-type water heater which provides for temperature regulation to permit stored water to maintain a constant temperature.

Another object is to provide an instantaneous-type water heater having a plurality of heating elements which are energized and de-energized, in a requested fashion, as heat is required or not required, to thereby prevent high current peaks from being drawn for the AC supply lines.

Still another object is to provide an instantaneous-type water heater having means for interrupting the flow of power through the heating elements when the fluid temperature exceeds an established temperature.

Still another object is to provide an instantaneous-type water heater wherein incoming fluid creates a degree of turbulence to mix the incoming fluid with the fluid in the heater and to carry out sediment.

In accordance with the present invention, a compact instantaneous-type water heater for universal use includes means for heating the water by passing any desired flow rate of cold water through a relatively small chamber containing an 18 kilowatt three-section electric heating element, and controlling the heating elements with sensors for control and safety. A small amount of heat is supplied to the chamber at all times, thus eliminating the first onrush of unheated water as is common with most water heaters of this type. Since the chamber holds only approximately 2 quarts of water, there is little loss in maintaining an even temperature during periods of nonuse.

A special electronic control circuit has been devised to eliminate the need for a flow switch to initiate the heating cycle on demand for hot water. Excessive pressure and temperature protection is provided by both a pressure relief valve, and a temperature sensitive switch which disconnects all power through a three-pole electrical contacter. These features provide a great margin of safety should there be any failure. The heating elements in the water chamber are energized by the flow of cold water as it passes over the thermistor probe located at the top of the heat chamber.

An especially unique feature of the present heater, is the use of solid state devices to individually control each of the three sections of the 18 kilowatt heater by dividing this control into separate 6 kilowatt sections which can be energized sequentially. The solid state devices include zero crossing trigger devices coupled respectively to solid state switches which control the supply of power to the heating elements. The zero crossing trigger devices include means for comparing a control potential and a ramp signal potential coupled to them and selectively gate the solid state switches to energize the heating elements in response to the comparison of the potentials. All of the heaters therefore are not switched on simultaneously and undersirable light flickering and radio frequency interference is prevented. It is further anticipated that the entire invention can be placed in a convenient case of such size which may be fitted between the stud walls of a residential or commercial building.

Other objects, advantages and capabilities of the invention will become apparent from the following description taken in conjunction with the accompanying drawings showing only a preferred embodiment to the invention.

DESCRIPTION OF THE PREFERRED EMBODIMENT

Figure 2:
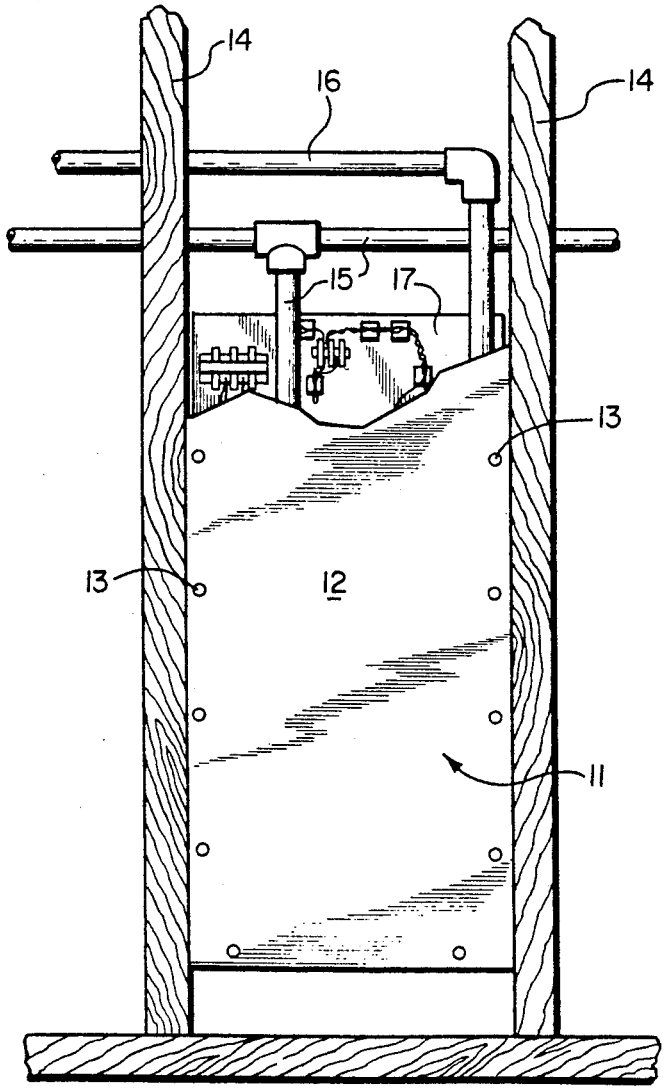
FIG. 2 is a front elevation view of the water heater mounted inside a conventional wood wall between the studs showing the cover partially broken away and showing standard utility connections.

Referring to the drawings wherein like numerals designate corresponding parts throughout the several figures, the instantaneous water heater of the present invention is indicated by the numeral 11. As viewed in FIG. 2, the heater 11 comprises a cover panel 12 affixed to the heater unit by suitable fasteners 13. The unit is shown mounted between wood stud wall members 14 in a conventional manner that allows the heater to be placed in a normal wall unit without protruding therefrom. Standard utility connections can be seen in FIG. 2 which includes a cold water inlet pipe 15 and a hot water discharge pipe 16. In FIG. 2, the back mounting panel 17 can be seen in the broken away section and this particular mounting panel is the panel to which all of the operative parts of the invention are mounted at the time of manufacture. It has been found, that by mounting the parts to the panel 17, maintenance of the entire unit is greatly simplified.

Figure 3:
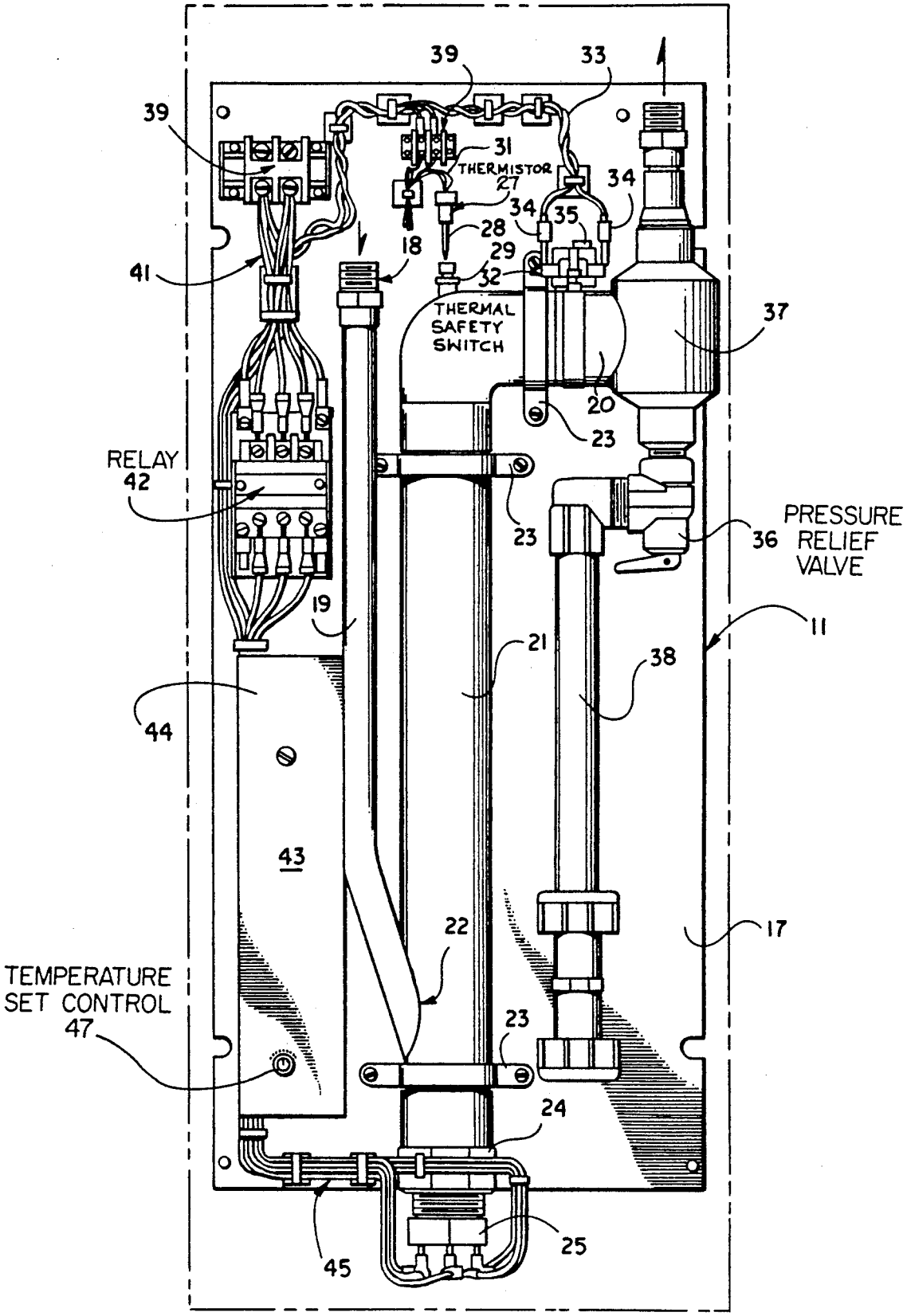
FIG. 3 is an overall elevation view of the water heater with the front panel cover being removed and showing all of the operative parts of the heater system.

Turning now to FIG. 3 which shows the operative portions of the present invention, it is seen that the cold water inlet pipe shown in FIG. 2, would normally be connected to the fitting 18 so as to supply system cold water to the cold water supply pipe 19. The in-rushing cold water is supplied to the copper tubular heating chamber 21 at a location near the bottom of the chamber as indicated by numeral 22. The pipe 19 is angled into the chamber so as to create a degree of turbulence to mix the water and to carry out any possible sediment, thereby preventing the possible shorting of the elements.

Figure 1:
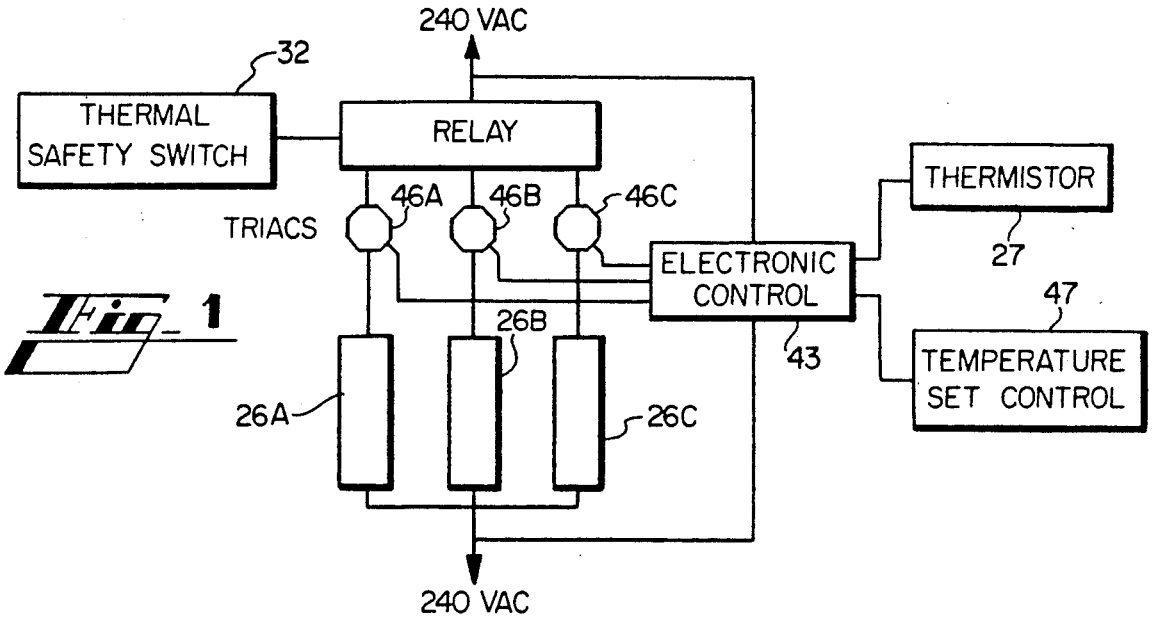
FIG. 1 is a simplified schematic diagram showing the overall concept of the instantaneous water heater.

The heating chamber 21 is an elongated tube which stores the water to be heated. In the preferred embodiment, the chamber holds approximately 2 quarts of water. The heating chamber 21 is maintained in a fixed position with respect to the mounting panel 17 by a series of hold-down clamps 23. At the bottom of the heating chamber there is a receiving coupling 24 which is affixed to the distal end of the chamber, and which is adapted to receive in mating engagement the heating element coupling 25 which is threaded into the bottom of the heating chamber. The heating element coupling is an immersion-type unit which has affixed thereto three elongated electrical heating elements 26 (as shown in the simplified schematic diagram of FIG. 1) which project into the heating chamber a sufficient distance to a position nearly to the top of the chamber. It is anticipated in the present embodiment that each heating element 26 will be a 6 kilowatt element which, as will be described later, will be sequentially energized with electrical energy depending on the flow of hot water which is being demanded.

The upper or discharge end 20 of the heating chamber 21 is coupled to a discharge chamber 37, and the discharge chamber 37 is coupled to the hot water discharge pipe 16. A thermistor unit 27 is affixed by means of a mounting bracket 29 to the discharge end 20 of the heating chamber 21 and projects into the heating chamber to monitor the temperature of the water contained within the heating chamber. The thermistor unit 27 comprises a probe 28 which is inserted into the mounting bracket 29 and which senses the temperature of the water in the heating chamber. This temperature information is conveyed to the associated electronic controls through suitable wiring 31. It is anticipated that as a novel function of the present invention, the thermistor senses the temperature of the water within the heating chamber 21 at all times and maintains a small amount of current to the heating elements so as to maintain a desired minimum temperature of the water within the heating chamber. If a minimum temperature is maintained at all times, then upon demand, there is no onrush of cold water to the user. Such is a decided improvement over the prior art. Should the water—once it has been heated and is being drawn by the user—exceed a desired maximum temperature, there is then provided a temperature-sensitive thermostatic safety switch 32 mounted upon the discharge end 20 of the heating chamber 21 between the heating chamber and the discharge chamber 37. The thermostatic safety switch 32 senses the temperature of the water within the chamber and should the water exceed the maximum safety range desired (which normally would be 185° F.), the thermostatic safety switch operates and cuts off the power to a relay 42 which, in turn, cuts off the electrical power to the electrical heating elements, as can be best seen in FIG. 5. The safety switch 32 is supplied with energy through wiring 33 by means of contacts 34. If the water heater is turned off by action of the thermostatic safety switch, then once the problem has been rectified, the unit is then reenergized by pushing the reset button 35 to re-activate the safety switch 32.

Another safety feature of the present invention is a manual temperature and pop-off pressure relief valve 36 mounted on the discharge chamber 37. It is anticipated, that if for some reason the temperature should exceed 210° F., or 150 pounds of pressure, the pressure relief valve 36 would open and discharge water through the discharge pipe 38 to a suitable overflow area.

Figure 4:
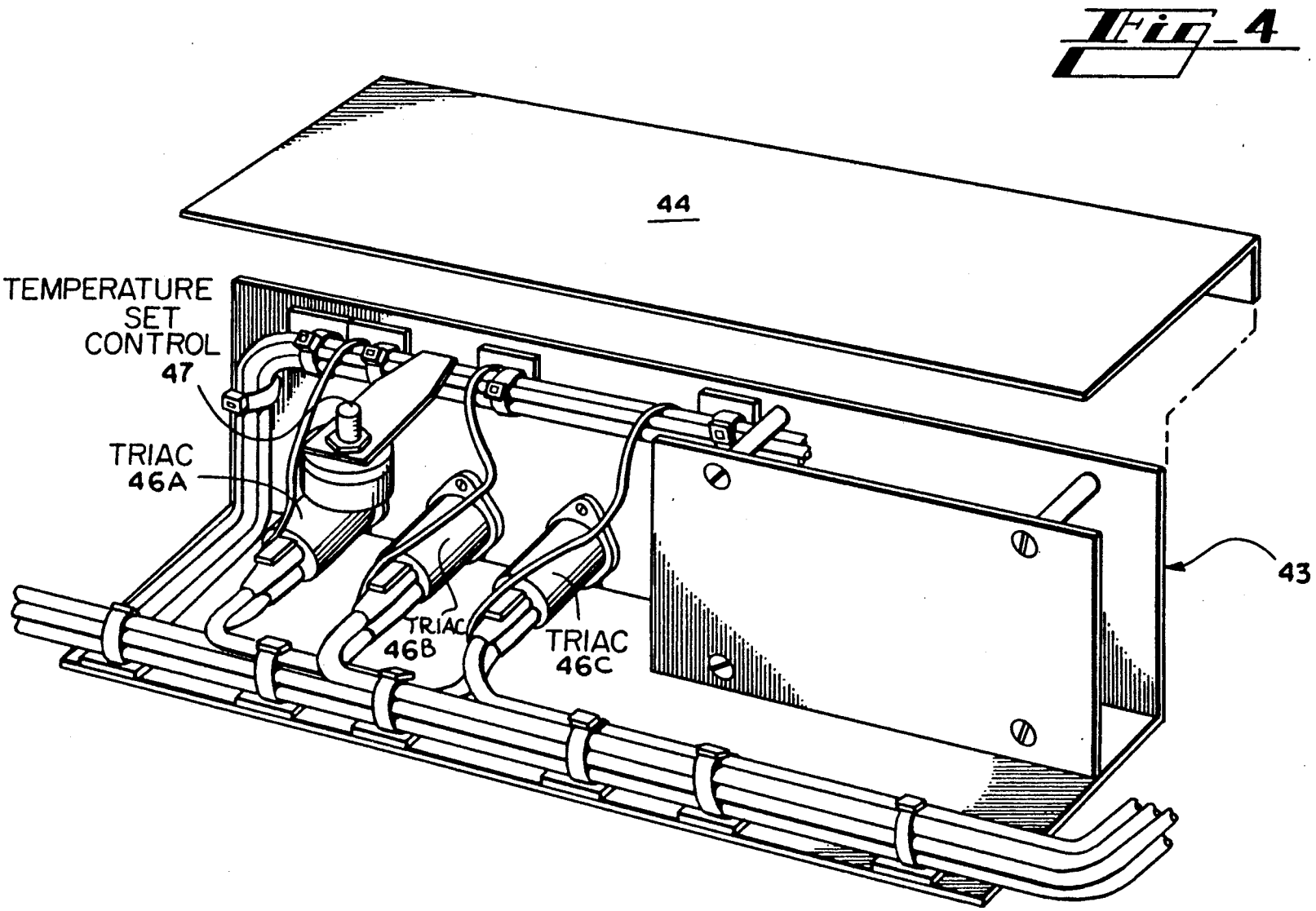
FIG. 4 is a perspective view of the electronic control box unit which controls the water heater, and this figure further shows the three Triacs which control the heating elements of the heater.

The electrical connections for the heater unit 11 are provided through terminal connecting block 39. Power is then supplied to the unit through suitable wiring 41 to a relay device 42 and thence to the electronic control unit 43. The control unit 43 is housed in a box structure 44 which is mounted through the mounting panel 17. Within the box 44 is housed the electronic controls for operating the entire water heating system including the control of the power supply to the heating elements 26A, 26B and 26C through the wiring bundle 45 and for the control of the thermistor unit 27 and the thermostatic safety switch 32. An integral part of the control unit comprises three Triacs 46A, 46B and 46C which are mounted in the box 44, as more particularly shown by FIG. 4. Each of the Triacs control one of the separate heating elements in the heating chamber 21. A user controlled temperature control switch 47 is shown mounted on the box 44 and this provides the ultimate user with means for controlling the desired temperature of the hot water exiting from the water heater.

Figure 5:
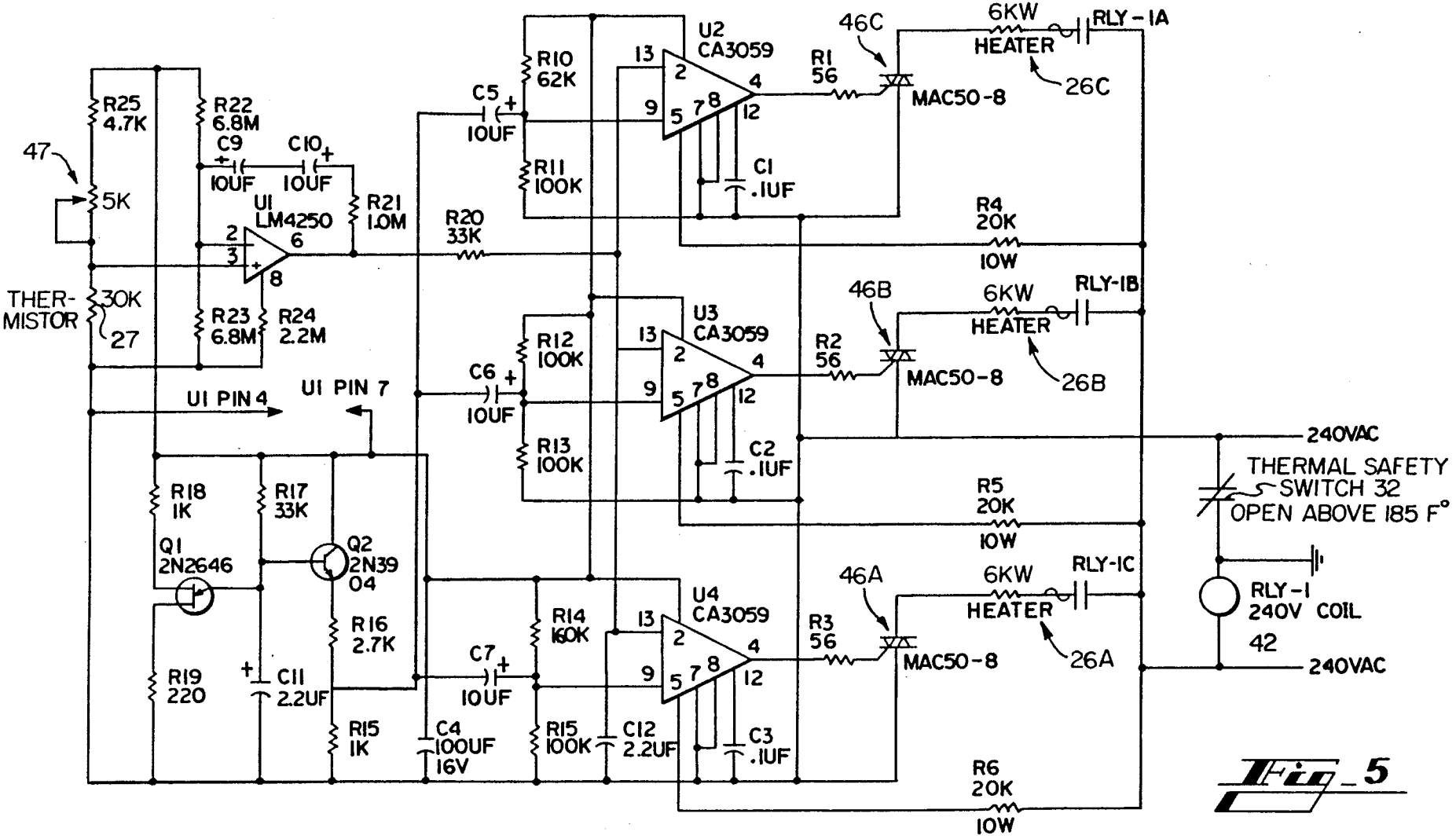
FIG. 5 is a wiring schematic diagram showing the novel control circuitry utilized in the present invention.

Referring now more particularly to FIG. 5 for a detailed description of the electronic controls for the water heater, it can be seen that the power to the heating elements (generally indicated in FIG. 1 by numerals 26A, 26B, and 26C), are controlled by the Triacs 46C, 46B and 46A. The Triacs are gated on by zero-crossing trigger devices U2, U3 and U4. A particularly unique aspect of the control circuitry is the manner in which the circuitry solves the problem of the extreme surge on the power source of switching an 18 kilowatt load on and off suddenly. Switching all three heaters simultaneously causes undesirable power surges which shows as light flickering and unacceptable disturbances in the line voltage in most residential locations. Proportional phase control of the Triacs would be one solution, but that has been found to have an undesireable side effect of creating radio frequency interference which would have to be dealt with separately by adding line filters.

The circuits herein have been devised so that the Triacs are staged sequentially as more heat is needed. Each individual Triac is always switched in the zero-crossing mode which causes a minimum of radio frequency interference.

The thermistor 27 senses the water temperature and this signal is amplified and conditioned for response time by the op-amp U1 and its associated circuitry. The control signal is fed from pin 6 of U1 to one of the inputs on each zero-crossing trigger by way of R20. The DC bias point for the reference input on U4 is set to approximately ⅓ of supply by R14 and R15. The reference input on U2 and U3, are set at ⅔ and ½ of supply respectively. Q1 comprises a saw-tooth oscillator which is buffered by Q2. Resistors R28 and R16 form a voltage divider which adjusts the ramp heighth to a little less then ⅓ of supply voltage. The ramp signal is coupled to the reference inputs of the zero-crossing triggers by capacitors C5, C6 and C7. This arrangement causes each of the zero-crossing triggers to have a ramp signal on its reference input which is off-set by a different DC voltage. As the control input increases, successive zero-gate triggers start to fire their respective Triacs causing proportional control. As the reference ramps overlap the control inputs, the zero-gate triggers start to fire and as the control input gets higher than the top of the ramp for a given zero-gate trigger device, its Triac turns on fully. As the control voltage continues to increase, it overlaps the ramp reference voltage of successive zero-gate trigger units until all Triacs are in the "on" condition thereby giving full power to the heaters.

More particularly, the sequence of operation as described above may be better understood by reference to the following description of an illustrative specific embodiment of the invention. If water temperature is adequately high for the present temperature set point (as established by resistor 47), the voltage on the output of the op-amp U1 will be near zero volts. This voltage is coupled to the control inputs (pins 13) of the zero crossing trigger devices U4, U3, and U2. This condition will not cause the trigger devices U4, U3, and U2 to send trigger pulses to the Triacs 46C, 46B and 46A to gate them on. Thus, no current flows through the heaters 26 and no heat is added to the water.

Unijunction transistor Q1 is a sawtooth ramp generator which generates a voltage ramp, with an established repetition rate. Emitter follower transistor Q2 buffers this signal and gives a lower impedance drive for the reference inputs (pins 9) of the zero crossing trigger device U4, U3, and U2.

The DC operating point of the reference input (pin 9) of the trigger device U4 is set near a fixed voltage. The ramp signal is coupled into the reference input of the trigger device U4 via the coupling capacitor C7. This results in a rising ramp voltage being applied to the reference input of trigger device U4. As long as the voltage on its control input (pin 13) remains below the ramp voltage on its reference input (pin 9), the trigger device U4 is not gated and no trigger pulses are sent to the Triac 46A.

When water temperature falls below the temperature value set by resistor 47, the op-amp U1 starts to put out a positive control voltage. This voltage is coupled to the control input (pin 13) of the trigger device U4 via R20. When the voltage on the control input (pin 13) of the trigger device U4 rises above the lowest ramp voltage on the reference input (pin 9) of the trigger device U4, then a trigger pulse will be sent to Triac 46A if a 60 Hz power zero crossing occurs during this time. As the control voltage continues to increase, more and more of the 60 Hz zero crossings will occur while the control voltage on the control input (pin 13) is greater than the ramp voltage on the reference input (pin 9) and an increased number of trigger pulses will be generated for Triac 46A. As the Triac 46A is gated on by these trigger pulses, current flows through the heater element 26A and more heat will be delivered to water in the chamber 21. When the control voltage at the control input (pin 13) of the trigger device U4 exceeds the higher end of the ramp voltage on its reference input (pin 9), all 60 Hz power crossings will cause the trigger device U4 to generate trigger pulses for Triac 46A and it will be turned on continuously so that current flows continuously through the heater element 26A to heat the water in the chamber 21.

The same sequence of operation occurs for the trigger devices U3 and U4 except that the DC operating point of the reference input (pin 9) of the trigger device U3 is set such that the ramp voltage at its reference input (pin 9) is set to start at a higher voltage and the DC operating point of the reference input (pin 9) of the trigger device U2 is set such that the ramp voltage at its reference input (pin 9) starts at a still higher voltage. The control voltage from the op-amp U1 is applied to the control inputs (pins 13) of the trigger devices U4, U3, and U2 simultaneously, but the trigger devices U4, U3 and U2 operate to sequentially turn on the Triacs 46C, 46B and 46A because of the different, fixed potentials applied to their reference inputs (pin 9) to which the ramp voltage is applied. With this arrangement, the trigger device U3 operates to gate Triac 46B on just as the trigger device U4 has turned Triac 46A full on. As the control voltage gets to the preset voltage, the top of the ramp voltage on trigger device U3 is exceeded and gating pulses are delivered to Triac 46A to turn it full on. When the control voltage reaches the higher voltage on the reference input (pin 9) of the trigger device U2, then the trigger device U2 delivers gate pulses to turn Triac 46C full on giving full power to all heating elements.

The same sequence of events occurs as the water in the heating chamber 21 is heated. As the water temperature rises and reaches or exceeds the temperature values set by the temperature set control 47, the control voltage supplied by op-amp U1 starts to drop, and as it does, the trigger device U4, U3 and U2 sequentially supply fewer trigger pulses to their associated Triacs 46A, 46B and 46C so that the heater elements 26C, 26B and 26A are energized for shorter periods of time, in a sequential fashion. Accordingly, the heater elements 26C, 26B and 26A are energized, and de-energized, in a sequential fashion, as heat is required or not required.

Various modifications may be made of the invention without departing from the scope thereof and it is desired, that only such limitations shall be placed thereon as are imposed by the prior art and which are set forth in the appended claims.

What is claimed is:

1. An instantaneous fluid heater comprising:

a fluid heating chamber having a fluid inlet and a discharge end, a discharge chamber coupled to said discharge end, said fluid inlet and said discharge chamber being positioned such that incoming fluid under pressure flows through said chamber from said fluid inlet to said discharge chamber;

a plurality of electrical heating elements mounted within said chamber in a position for heating said fluids as it flows through said chamber;

a plurality of solid state switches, each independently controlling the supply of electrical power to a separate one of said heating elements;

a plurality of zero crossing trigger devices coupled respectively to a separate one of said solid state switches for gating said solid state switches to supply power to said heating elements;

sensor means at the discharge end of said chamber for sensing the temperature of the fluid flowing out of said chamber and for providing a control potential corresponding to the degree of need for heating energy to each of the respective ones of said trigger devices;

means for providing a ramp signal potential to each of the respective ones of said zero crossing trigger devices;

means for superimposing a different, fixed potential to each of said ramp signal potentials whereby said ramp signal potentials provided to each of said respective ones of said zero crossing trigger devices are offset by a different, fixed potential;

each of said zero crossing trigger devices including means for comparing said control potential and said ramp signal potential and causing said respective zero crossing trigger devices to selectively gate said solid state switches to energize said heating elements in response to the comparison of said potentials.

2. The instantaneous fluid heater of claim 1, further comprising monitoring means coupled to said discharge chamber for monitoring the temperature of the fluid flowing therethrough; and relay means for controlling the flow power through said heating elements, said monitoring means upon sensing a temperature of the fluid exceeding an established temperature operating said relay means to interrupt the flow of power through said heating elements.

3. The instantaneous fluid heater of claim 2, wherein said monitoring means and said relay means are coupled in series relationship with the source of power coupled to said heating elements, said relay means having a plurality of contacts, each of which is coupled in series relationship with a separate one of said heating elements and controlling the flow of power to said heating element, said relay means normally being operated to close said contacts and thereby permitting power to flow through said heating elements, said monitoring means upon sensing a temperature of the fluid exceeding an established temperature operating said relay means to open said contacts to thereby interrupt the flow of power through said heating elements.

4. The instantaneous fluid heater of claim 1, wherein said fluid inlet is coupled to the side of said fluid heating chamber at an angle and near the bottom thereof, whereby incoming fluid creates a degree of turbulence to mix the incoming fluid with the fluid in the chamber and to carry out sediment.

5. The instantaneous fluid heater of claim 1, wherein said sensor means comprises a thermistor.

6. The instantaneous fluid heater of claim 1, wherein said means for providing a ramp signal comprises a saw-tooth oscillator.

* * * * *